US009980359B2

(12) United States Patent
Riggs et al.

(10) Patent No.: US 9,980,359 B2
(45) Date of Patent: May 22, 2018

(54) SYSTEMS AND METHODS FOR CONTROLLING EUV ENERGY GENERATION USING PULSE INTENSITY

(71) Applicant: ASML Netherlands B.V., Veldhoven (NL)

(72) Inventors: Daniel Jason Riggs, San Diego, CA (US); Robert Jay Rafac, Encinitas, CA (US)

(73) Assignee: ASML Netherlands B.V., Veldhoven (NL)

( * ) Notice: Subject to any disclaimer, the term of this patent is extended or adjusted under 35 U.S.C. 154(b) by 14 days.

(21) Appl. No.: 14/824,289

(22) Filed: Aug. 12, 2015

(65) Prior Publication Data

US 2017/0048960 A1 Feb. 16, 2017

(51) Int. Cl.
*H05G 1/30* (2006.01)
*H05G 2/00* (2006.01)

(52) U.S. Cl.
CPC ..... *H05G 2/008* (2013.01); *H05G 2/003* (2013.01); *H05G 1/30* (2013.01)

(58) Field of Classification Search
CPC ..... H05G 2/008; H05G 2/001; H05G 1/30; G03F 7/70033
See application file for complete search history.

(56) References Cited

U.S. PATENT DOCUMENTS

2006/0084957 A1* 4/2006 Delfyett ..... A61B 18/20 606/12
2010/0220756 A1* 9/2010 Krzysztof ..... H01S 3/235 372/38.02
2013/0322482 A1* 12/2013 Sandstrom ..... H01S 3/08 372/50.11
2014/0191132 A1* 7/2014 Schafgans ..... H05G 2/003 250/372
2016/0087389 A1* 3/2016 Niwano ..... H01S 3/10015 250/504 R

* cited by examiner

*Primary Examiner* — Brooke Purinton
(74) *Attorney, Agent, or Firm* — Arent Fox LLP

(57) ABSTRACT

In a laser produced plasma (LPP) extreme ultraviolet (EUV) system, a plasma created from droplets irradiated by a laser pulse can become destabilized. The instability of the plasma can reduce the amount of EUV energy generated over time. While other systems seek to stabilize the plasma by varying a pulse width of the laser pulses, the systems and methods described herein stabilize the plasma by varying an intensity of the laser pulses. The intensity of the laser pulses is varied based on a comparison of the amount of EUV energy generated from current pulse to an expected amount of EUV energy. The intensity of the laser pulses can be varied on a pulse-by-pulse basis by an EUV controller that instructs a pulse actuator.

14 Claims, 4 Drawing Sheets

SYSTEMS AND METHODS FOR CONTROLLING EUV ENERGY GENERATION USING PULSE INTENSITY

BACKGROUND

Field of Invention

This non-provisional United States patent application is directed generally to laser produced plasma (LPP) extreme ultraviolet (EUV) systems and more particularly to systems and methods for controlling EUV energy generation.

Description of Related Art

The semiconductor industry continues to develop lithographic technologies which are able to print ever-smaller integrated circuit dimensions. Extreme ultraviolet ("EUV") light (also sometimes referred to as soft x-rays) is generally defined to be electromagnetic radiation having wavelengths of between 10 and 120 nanometers (nm) with shorter wavelengths expected to be used in the future. EUV lithography is currently generally considered to include EUV light at wavelengths in the range of 10-14 nm, and is used to produce extremely small features, for example, sub-32 nm features, in substrates such as silicon wafers. To be commercially useful, it is desirable that these systems be highly reliable and provide cost effective throughput and reasonable process latitude.

Methods to produce EUV light include, but are not necessarily limited to, converting a material into a plasma state that has one or more elements, e.g., xenon, lithium, tin, indium, antimony, tellurium, aluminum, etc., with one or more emission line(s) in the EUV range. In one such method, often termed laser produced plasma ("LPP"), the required plasma can be produced by irradiating a target material, such as a droplet, stream or cluster of material having the desired line-emitting element, with a laser beam at an irradiation site. The line-emitting element may be in pure form or alloy form, for example, an alloy that is a liquid at desired temperatures, or may be mixed or dispersed with another material such as a liquid.

In some prior art LPP systems, droplets in a droplet stream are irradiated by a separate laser pulse to form a plasma from each droplet. Alternatively, some prior art systems have been disclosed in which each droplet is sequentially illuminated by more than one light pulse. In some cases, each droplet may be exposed to a so-called "pre-pulse" to heat, expand, gasify, vaporize, and/or ionize the target material and/or generate a weak plasma, followed by a so-called "main pulse" to generate a strong plasma and convert most or all of the pre-pulse affected material into plasma and thereby produce an EUV light emission. It will be appreciated that more than one pre-pulse may be used and more than one main pulse may be used, and that the functions of the pre-pulse and main pulse may overlap to some extent.

Since EUV output power in an LPP system generally scales with the drive laser power that irradiates the target material, in some cases it may also be considered desirable to employ an arrangement including a relatively low-power oscillator, or "seed laser," and one or more amplifiers to amplify the pulses from the seed laser. The use of a large amplifier allows for the use of a low power, stable seed laser while still providing the relatively high power pulses used in the LPP process.

Systems currently known and used in the art typically set a fixed pulse width for the main pulse that is expected to produce the greatest amount of EUV energy under ideal conditions. In these systems, an oscillation in the amount of EUV energy generated is observed. Current techniques used to reduce the oscillation involve varying the pulse width and/or by modulating the timing of the laser pulses.

SUMMARY

According to various embodiments, a method comprises: measuring, by an extreme ultraviolet (EUV) energy detector, an amount of EUV energy generated in a plasma chamber of a laser produced plasma (LPP) EUV system resulting from a first laser pulse having a first pulse width and a first intensity impacting a droplet to create a plasma in the plasma chamber; comparing, by an EUV controller, the measured amount of EUV energy generated to an expected amount of EUV energy to determine a present stability of the plasma within the plasma chamber; and instructing, by the EUV controller and based on the determined present stability of the plasma within the plasma chamber, a pulse actuator to modify by a gain factor an intensity of a subsequent laser pulse relative to the first intensity, the subsequent laser pulse also having the first pulse width.

According to various embodiments, a laser produced plasma (LPP) extreme ultraviolet (EUV) system, comprises: an EUV energy detector configured to measure an amount of EUV energy generated in a plasma chamber resulting from a first laser pulse having a first pulse width and a first intensity impacting a droplet to create a plasma in the plasma chamber; and an EUV controller configured to: compare the measured amount of EUV energy generated to an expected amount of EUV energy to determine a present stability of the plasma within the plasma chamber, and instruct, based on the determined present stability of the plasma within the plasma chamber, a pulse actuator to modify by a gain factor an intensity of a subsequent laser pulse relative to the first intensity, the subsequent laser pulse also having the first pulse width.

According to various embodiments, a non-transitory computer-readable medium has instructions embodied thereon, the instructions executable by one or more processors to perform operations comprising: obtaining, from an extreme ultraviolet (EUV) energy detector, a measured amount of EUV energy generated in a plasma chamber of a laser produced plasma (LPP) EUV system resulting from a first laser pulse having a first pulse width and a first intensity impacting a droplet to create a plasma in the plasma chamber; comparing the measured amount of EUV energy generated to an expected amount of EUV energy to determine a present stability of the plasma within the plasma chamber; and instructing, based on the determined present stability of the plasma within the plasma chamber, a pulse actuator to modify by a gain factor an intensity of a subsequent laser pulse relative to the first intensity, the subsequent laser pulse also having the first pulse width.

DETAILED DESCRIPTION

In LPP EUV systems, the impact of a laser pulse striking a droplet to generate a plasma at an irradiation site in a plasma chamber can cause forces in the plasma chamber. The forces in the plasma chamber slow subsequent droplets approaching the irradiation site and/or destabilize the plasma at the irradiation site. These forces are not directly measurable but can be indirectly observed and measured from the amount of EUV energy generated in the plasma chamber.

To generate an expected amount of EUV energy, these forces are counteracted by adjusting the intensity of the laser pulse while the duration of the pulse width is held constant (or nearly constant). By adjusting the intensity of the laser pulse in response to feedback indicating the amount of EUV energy generated, the plasma can be stabilized, resulting in better realization of EUV energy relative to the expected amount of EUV energy.

Figure 1:
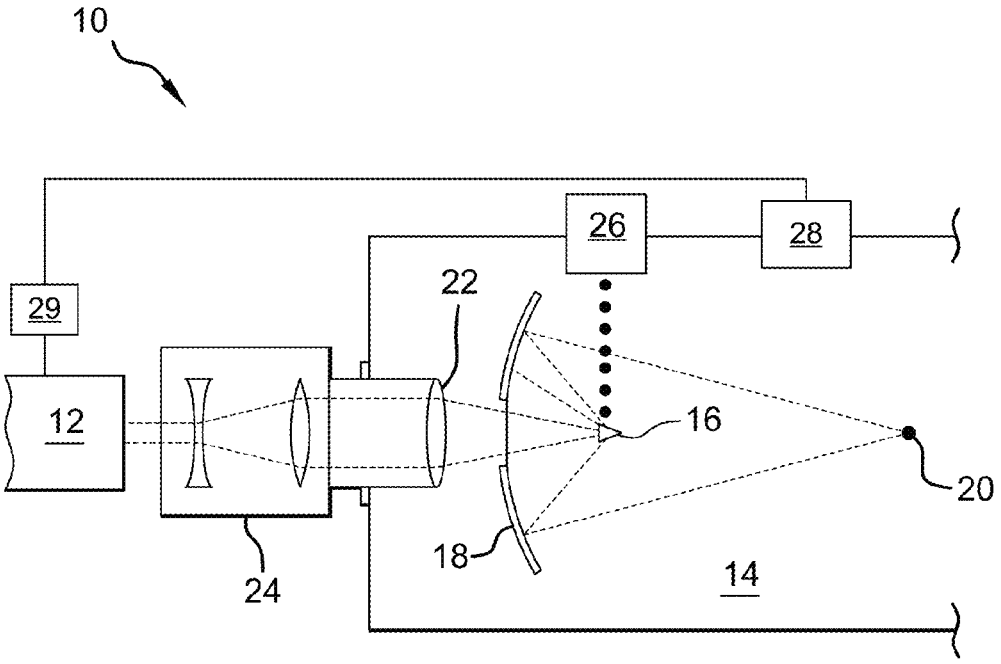
FIG. 1 is a simplified schematic view of some of the components of one embodiment of an LPP EUV light source.

FIG. 1 is a simplified schematic view of some of the components of one embodiment of an LPP EUV light source 10. As shown in FIG. 1, the EUV light source 10 includes a laser source 12 for generating a beam of laser pulses and delivering the beam along one or more beam paths from the laser source 12 and into a plasma chamber 14 to illuminate a respective target, such as a droplet, at an irradiation site 16.

As also shown in FIG. 1, the EUV light source 10 may also include a target material delivery system 26 that, for example, delivers droplets of a target material into the interior of plasma chamber 14 to the irradiation site 16, where the droplets will interact with one or more laser pulses to ultimately produce plasma and generate an EUV emission. Various target material delivery systems have been presented in the prior art, and their relative advantages will be apparent to those of skill in the art.

As above, the target material is an EUV emitting element that may include, but is not necessarily limited to, a material that includes tin, lithium, xenon or combinations thereof. The target material may be in the form of liquid droplets, or alternatively may be solid particles contained within liquid droplets. For example, the element tin may be presented as a target material as pure tin, as a tin compound, such as $SnBr_4$, $SnBr_2$, $SnH_4$, as a tin alloy, e.g., tin-gallium alloys, tin-indium alloys, or tin-indium-gallium alloys, or a combination thereof. Depending on the material used, the target material may be presented to the irradiation site 16 at various temperatures including room temperature or near room temperature (e.g., tin alloys or $SnBr_4$), at a temperature above room temperature (e.g., pure tin), or at temperatures below room temperature (e.g., $SnH_4$). In some cases, these compounds may be relatively volatile, such as $SnBr_4$. Similar alloys and compounds of EUV emitting elements other than tin, and the relative advantages of such materials and those described above will be apparent to those of skill in the art.

Returning to FIG. 1, the EUV light source 10 may also include an optical element 18 such as a near-normal incidence collector mirror having a reflective surface in the form of a prolate spheroid (i.e., an ellipse rotated about its major axis), such that the optical element 18 has a first focus within or near the irradiation site 16 and a second focus at a so-called intermediate region 20, where the EUV light may be output from the EUV light source 10 and input to a device utilizing EUV light such as an integrated circuit lithography tool (not shown). As shown in FIG. 1, the optical element 18 is formed with an aperture to allow the laser light pulses generated by the laser source 12 to pass through and reach the irradiation site 16.

The optical element 18 should have an appropriate surface for collecting the EUV light and directing it to the intermediate region 20 for subsequent delivery to the device utilizing the EUV light. For example, optical element 18 might have a graded multi-layer coating with alternating layers of molybdenum and silicon, and in some cases, one or more high temperature diffusion barrier layers, smoothing layers, capping layers and/or etch stop layers.

It will be appreciated by those of skill in the art that optical elements other than a prolate spheroid mirror may be used as optical element 18. For example, optical element 18 may alternatively be a parabola rotated about its major axis or may be configured to deliver a beam having a ring-shaped cross section to an intermediate location. In other embodiments, optical element 18 may utilize coatings and layers other than or in addition to those described herein. Those of skill in the art will be able to select an appropriate shape and composition for optical element 18 in a particular situation.

As shown in FIG. 1, the EUV light source 10 may include a focusing unit 22 which includes one or more optical elements for focusing the laser beam to a focal spot at the irradiation site 16. EUV light source 10 may also include a beam conditioning unit 24, having one or more optical elements, between the laser source 12 and the focusing unit 22, for expanding, steering and/or shaping the laser beam, and/or shaping the laser pulses. Various focusing units and beam conditioning units are known in the art, and may be appropriately selected by those of skill in the art.

As noted above, in some cases laser source 12 comprises seed lasers and one or more amplifiers. The seed laser generates laser pulses, which are then amplified to become the laser beam that irradiates the target material at irradiation site 16 to form a plasma that produces the EUV emission.

One of skill in the art will appreciate that a number of types of seed lasers may be used to generate the pre-pulse and the main pulse. For example, a conventional dual-chamber transverse-flow laser source in what has traditionally been known as a "master oscillator-power amplifier" ("MOPA") configuration may be used. Alternatively, the power amplifier may comprise a fast-axial flow laser. A single laser source may produce both the pre-pulse and the main pulse. Alternatively, separate seed lasers may be used to produce the pre-pulse and the main pulse, in what is commonly known as a MOPA+PP laser.

One type of seed laser commonly used in some embodiments of EUV systems is a $CO_2$ laser, while other embodiments may use a YAG (yttrium-aluminum-garnet) laser. Where there are two seed lasers, they may be of different types; however, for example, a YAG laser will need a separate amplifier or amplifier chain than a $CO_2$ laser. One of skill in the art will recognize that there are other types of lasers than $CO_2$ and YAG lasers, and other configurations than MOPA and MOPA+PP lasers, and will be able to determine which types and configurations of lasers will be suitable for the desired application.

Returning to FIG. 1, an EUV energy detector 28 detects the amount of EUV power generated in the plasma chamber 14. The EUV energy detector 28 is either a sensor within the plasma chamber 14, e.g., an EUV side sensor positioned at 90° with respect to the laser beam or a sensor within the scanner measuring energy passed through intermediate focus 20. EUV energy detectors comprise photodiodes and are generally known to those skilled in the art. As is familiar to those skilled in the art, by integrating the EUV power signal provided by the EUV energy detector 28 over the time span that the droplet is irradiated, the EUV energy generated from the impact of the droplet and the laser pulse is calculated.

An EUV controller 29 is configured to determine an intensity of a next laser pulse based on the amount of EUV generated by one or more previous pulse. The EUV controller obtains, via the EUV energy detector 28, measurements of amounts of EUV generated from previous pulses. The EUV controller 29 determines, using an algorithm described below, a target intensity of a subsequent laser pulse. The target intensity is based on a determined stability of the plasma persisting between laser pulses in the plasma chamber 14. The more stable the plasma is, the higher the intensity of the subsequent laser pulse can be, up to a known limit. If the plasma is less stable or unstable, the EUV controller 29 can reduce the intensity of the subsequent laser pulse.

The EUV controller 29 can be implemented in a variety of ways known to those skilled in the art including, but not limited to, as a computing device having a processor with access to a memory capable of storing executable instructions for performing the functions of the described modules. The computing device can include one or more input and output components, including components for communicating with other computing devices via a network (e.g., the Internet) or other form of communication. The EUV controller 29 comprises one or more modules embodied in computing logic or executable code such as software.

A pulse actuator (not shown) actuates the laser source 12 to fire the laser pulse at the irradiation site 16. Actuators can be electrical, mechanical, and/or optical components and are generally known to those skilled in the art.

Figure 2:
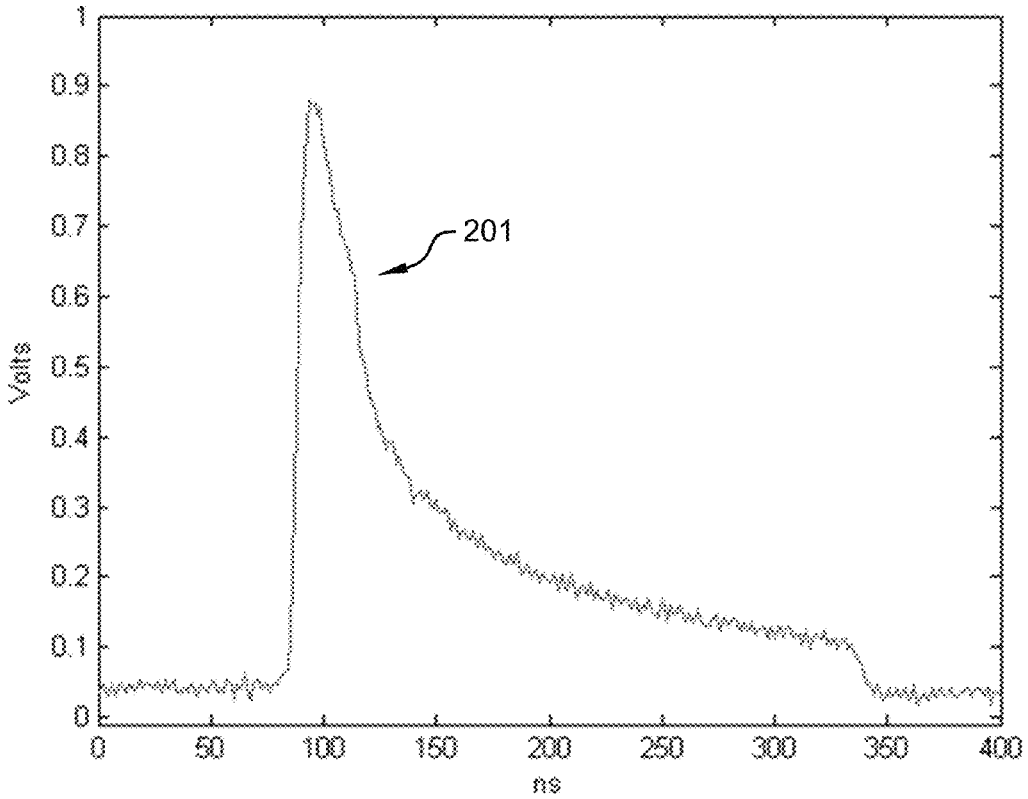
FIG. 2 is a graph of a typical main laser pulse from a $CO_2$ drive laser after it passes through an amplifier.

FIG. 2 is a graph of a typical main laser pulse from a $CO_2$ drive laser after it passes through an amplifier, with curve 201 showing the intensity (y-axis) of the pulse over time (x-axis). It may be seen that the intensity falls off steeply after the initial peak; this is typical of the passing of a pulse through an amplifier, as the leading edge of the pulse saturates the amplifier and uses most of the gain as it passes. The pulse width as illustrated is approximately 250 nanoseconds (ns) from the leading edge (at about 80 ns on the x-axis) to the trailing edge (at about 330 ns on the x-axis). This is typical of a main pulse in a traditional MOPA configuration, which has generally been in the range of 100 to 300 ns, and longer than a typical main pulse in a MOPA+PP configuration, in which main pulses close to 100 ns are now used. Pre-pulses have generally been in the range of 50 to 150 ns, and may now be 30 to 70 ns. Both main pulses and pre-pulses are expected to continue to shorten in the future, possibly even into ranges measured in picoseconds.

As above, in the prior art, a pulse width that is shorter than a Q-switched pulse from the seed laser is generally selected in advance. This may be accomplished, for example, by passing the pulse through an optical switch, such as an electro-optic modulator (EOM), which may be located in the laser source 12 of FIG. 1 and which acts as a shutter to shorten the pulse, opening to allow the leading edge of the pulse to pass and then closing to cut off the tail end of the pulse at the desired point.

Figure 3:
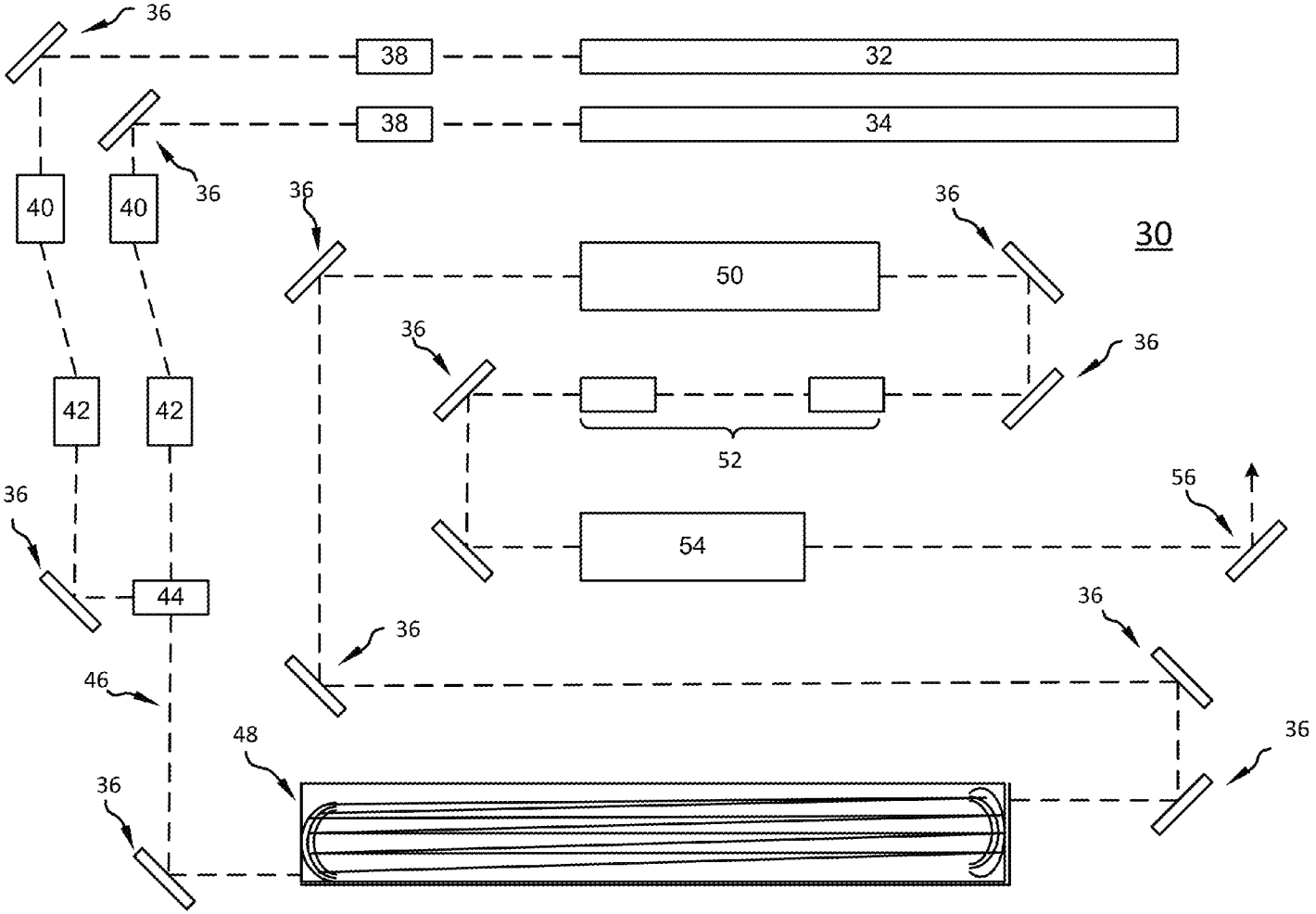
FIG. 3 is an illustration of some of the components of a seed laser module that may be used in an LPP EUV system.

As illustrated in FIG. 3, seed laser module 30 includes two seed lasers, a pre-pulse seed laser 32 and a main pulse seed laser 34. One of skill in the art will appreciate that where such an embodiment containing two seed lasers is used, the target material may be irradiated first by one or more pulses from the pre-pulse seed laser 32 and then by one or more pulses from the main pulse seed laser 34.

Seed laser module 30 is shown as having a "folded" arrangement rather than arranging the components in a straight line. In practice, such an arrangement is typical in order to limit the size of the module. To achieve this, the beams produced by the laser pulses of pre-pulse seed laser 32 and main pulse seed laser 34 are directed onto desired beam paths by a plurality of optical components 36. Depending upon the particular configuration desired, optical components 36 may be such elements as lenses, filters, prisms, mirrors or any other element which may be used to direct the beam in a desired direction. In some cases, optical components 36 may perform other functions as well, such as altering the polarization of the passing beam.

As is known to those of skill in the art, the seed lasers contain optical components, such as the output coupler, polarizer, rear mirror, grating, acousto-optical modulation (AOM) switches, etc. Among these optical components, the seed lasers 32 and 34 contain a Q-switch AOM used in giant pulse formation and to produce a pulsed output beam. As is known in the art, the Q-switch AOM controls the timing of the release of the pulse from the seed laser.

In the embodiment of FIG. 3, the beams from each seed laser are first passed through an electro-optic modulator 38 (EOM). The EOMs 38 are used with the seed lasers as pulse shaping units to trim the pulses generated by the seed lasers to pulses having shorter duration and faster fall-time. A shorter pulse duration and relatively fast fall-time may increase EUV output and light source efficiency because of a short interaction time between the pulse and a target, and because unneeded portions of the pulse do not deplete amplifier gain. While two separate pulse shaping units (EOMs 38) are shown, alternatively a common pulse shaping unit may be used to trim both pre-pulse and main pulse seeds.

In some embodiments described herein, the EUV controller 29 can control the intensity of the laser pulse by adjusting the timing of the EOM 38 relative to a Q-switch AOM within the seed laser. In an embodiment, the timing is adjusted by changing the delay of the Q-switch AOM trigger or EOM trigger relative to laser firing trigger which is based on when the droplet arrived at a detection line laser in the plasma chamber.

In other embodiments, as would be understood by one of skill in the art in light of the teachings herein, the EUV controller 29 can control the intensity of the laser pulse by changing the voltage applied to the seed EOM crystal of the EOM 38. One material that may be used for such a crystal is cadmium telluride (CdTe); there are other materials used in EOMs as well. When a high voltage HV (about 5,000 volts, or 5 kilovolts or kV) is applied to the crystal, light is able to pass through the EOM 38. When no voltage is applied to EOM 38, the laser pulse does not pass through the EOM 38. To control the intensity of the pulse, the high voltage HV is adjusted in proportion to the desired intensity. As such, to generate a laser pulse with a higher intensity, the high voltage HV applied to the crystal is increased and, to generate a laser pulse with a lower intensity, the high voltage HV applied to the crystal is decreased.

Returning to FIG. 3, the beams from the seed lasers are then passed through acousto-optic modulators (AOMs) 40 and 42. As will be explained below, the AOMs 40 and 42 act as "switches" or "shutters," which operate to divert any reflections of the laser pulses from the target material from reaching the seed lasers; as above, seed lasers typically contain sensitive optics, and the AOMs 40 and 42 thus prevent any reflections from causing damage to the seed laser elements. In the embodiment shown here, the beams from each seed laser pass through two AOMs; however, in some embodiments, the beams from each seed laser may be passed through only a single AOM on each path.

In some embodiments, to adjust the intensity of the laser pulses, the AOMs 40 and 42 can be manipulated. The AOMs 40 and 42 are opened and closed by applying radio frequency (RF) power to a transducer bonded to a crystal within the AOM. The intensity of the laser pulse is proportional to the amount of RF power applied. Thus, to increase the intensity of the laser pulse, more RF power is applied and to reduce the intensity of the laser pulse, less RF power is applied.

After passing through the AOMs 40 and 42, the two beams are "combined" by beam combiner 44. Since the pulses from each seed laser are generated at different times, this really means that the two temporally separated beams are placed on a common beam path 46 for further processing and use.

After being placed on the common beam path, the beam from one of the seed lasers (again, there will only be one at a time) passes through a beam delay unit 48 such as is known in the art. Next, the beam is directed through a pre-amplifier 50 and then through a beam expander 52. Following this, the beam passes through a thin film polarizer 54, and is then directed onward by optical component 56, which again is an element which directs the beam to the next stage in the LPP EUV system and may perform other functions as well. From optical component 56, the beam typically passes to one or more optical amplifiers and other components, as is known in the art.

Various wavelength tunable seed lasers that are suitable for use as both pre-pulse and main pulse seed lasers are known in the art. For example, in one embodiment a seed laser may be a $CO_2$ laser having a sealed filling gas including $CO_2$ at sub-atmospheric pressure, for example, 0.05 to 0.2 atmospheres, and pumped by a radio-frequency discharge. In some embodiments, a grating may be used to help define the optical cavity of the seed laser, and the grating may be rotated to tune the seed laser to a selected rotational line.

Figure 4:
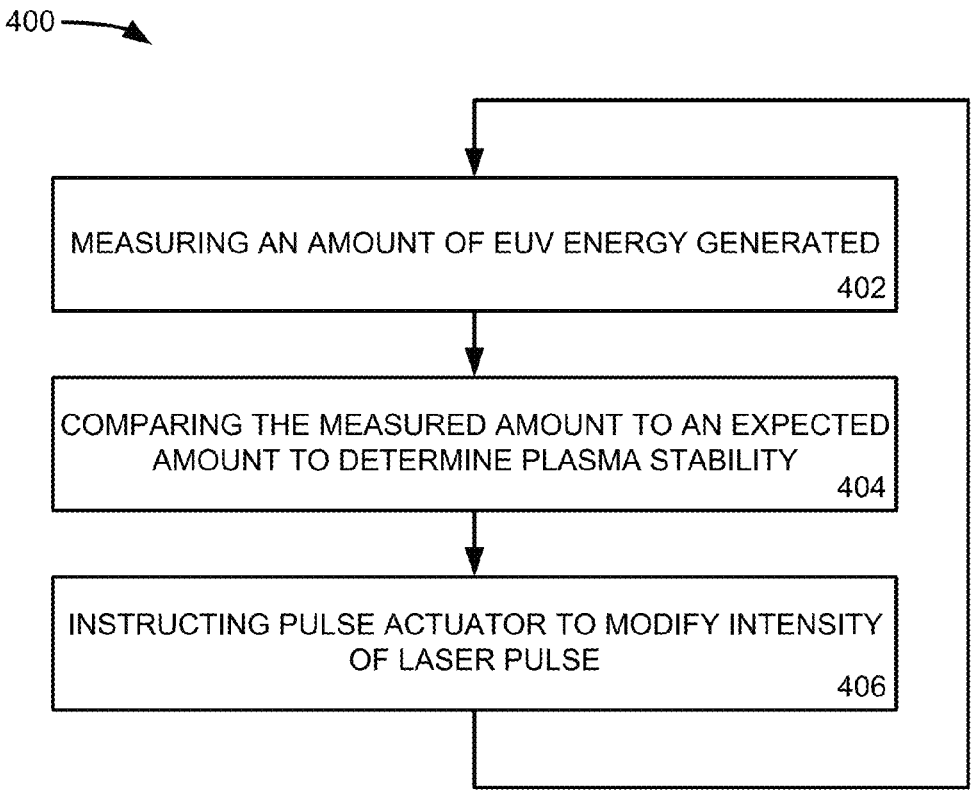
FIG. 4 is a flowchart of an example method for controlling the intensity of the pulse, according to some embodiments.

FIG. 4 is a flowchart of an example method 400 for controlling the intensity of the laser pulse, according to some embodiments. The method 400 may be performed by, for example, the EUV energy detector 28 and the EUV controller 29.

In an operation 402, an amount of EUV energy generated from a laser pulse impacting a droplet is measured by, for example, the EUV energy detector 28 of FIG. 1. The amount of EUV energy generated is at least partially dependent on the stability of the plasma that persists between, and is created by, the droplets.

In an operation 404, the measured amount of the EUV energy generated is compared to an expected amount of EUV energy to determine plasma stability by, for example, the EUV controller 29 of FIG. 1. The plasma, and the impact of the droplets with the plasma, exerts forces on the incoming droplets causing them to slow as they approach the plasma. As such, a subsequent laser pulse may only hit a leading edge of a subsequent droplet rather than the entire droplet resulting in less EUV energy generated. By stabilizing the plasma, these forces are mitigated, resulting in more of the droplet being hit by the laser pulse thereby avoiding a reduction in resulting EUV energy generation. As such, by comparing the amount of EUV energy generated to the expected amount of EUV energy, a relative stability of the plasma can be determined. The expected amount of EUV energy is an amount of EUV energy that an operator expects to be generated based on the operating parameters of the LPP EUV system.

In an operation 406, the pulse actuator is instructed to modify an intensity of a next laser pulse. The instruction is generated by calculating the intensity of the next laser pulse using a gain factor. The instruction can be generated and sent to the pulse actuator by, for example, the EUV controller 29.

In some embodiments, the intensity of the laser pulse is modified by instructing the pulse actuator to change an amount of RF power provided to an AOM in the source laser. In other embodiments, the intensity of the laser pulse is modified by instructing the pulse actuator to change a high voltage applied to a seed EOM crystal. In still other embodiments, the intensity of the laser pulse is modified by instructing the pulse actuator to change a timing of triggering a seed EOM relative to a Q-switch AOM. The intensity of the laser pulses can be modified to vary in real time, from one pulse to the next, and/or droplet-by-droplet.

The disclosed method and apparatus has been explained above with reference to several embodiments. Other embodiments will be apparent to those skilled in the art in light of this disclosure. Certain aspects of the described method and apparatus may readily be implemented using configurations other than those described in the embodiments above, or in conjunction with elements other than those described above. For example, different algorithms and/or logic circuits, perhaps more complex than those described herein, may be used, and possibly different types of drive lasers and/or focus lenses.

Note that as used herein, the term "optical component" and its derivatives includes, but is not necessarily limited to, one or more components which reflect and/or transmit and/or operate on incident light and includes, but is not limited to, one or more lenses, windows, filters, wedges, prisms, grisms, gratings, transmission fibers, etalons, diffusers, homogenizers, detectors and other instrument components, apertures, axicons and mirrors including multi-layer mirrors, near-normal incidence mirrors, grazing incidence mirrors, specular reflectors, diffuse reflectors and combinations thereof. Moreover, unless otherwise specified, neither the terms "optic," "optical component" nor their derivatives, as used herein, are meant to be limited to components which operate solely or to advantage within one or more specific wavelength range(s) such as at the EUV output light wavelength, the irradiation laser wavelength, a wavelength suitable for metrology or some other wavelength.

As noted herein, various variations are possible. A single seed laser may be used in some cases rather than the two seed lasers illustrated in the Figures. A common switch may protect two seed lasers, or either or both of the seed lasers may have their own switches for protection. A single Bragg AOM may be used in some instances, or more than two Bragg AOMs may be used to protect a single seed laser if desired.

It should also be appreciated that the described method and apparatus can be implemented in numerous ways, including as a process, an apparatus, or a system. The methods described herein may be implemented by program instructions for instructing a processor to perform such methods, and such instructions recorded on a non-transitory computer readable storage medium such as a hard disk drive, floppy disk, optical disc such as a compact disc (CD) or digital versatile disc (DVD), flash memory, etc, The program instruction can be communicated from the non-transitory computer readable storage medium over a computer network including optical or electronic communication links. Such program instructions may be executed by means of a processor or controller, or may be incorporated into fixed logic elements. It should be noted that the order of the steps of the methods described herein may be altered and still be within the scope of the disclosure.

These and other variations upon the embodiments are intended to be covered by the present disclosure, which is limited only by the appended claims.

What is claimed is:

1. A method comprising:

measuring, by an extreme ultraviolet (EUV) energy detector, an amount of EUV energy generated in a plasma chamber of a laser produced plasma (LPP) EUV system resulting from a first laser pulse having a first pulse width and a first intensity impacting a droplet to create a plasma in the plasma chamber;

comparing, by an EUV controller, the measured amount of EUV energy generated to an expected amount of EUV energy to determine a present stability of the plasma within the plasma chamber; and instructing, by the EUV controller and based on the determined present stability of the plasma within the plasma chamber, a pulse actuator to modify by a gain factor an intensity of a subsequent laser pulse relative to the first intensity, the subsequent laser pulse also having the first pulse width.

2. The method of claim 1, further comprising:

measuring, by the EUV energy detector, a subsequent amount of EUV energy generated from the subsequent laser pulse impacting a subsequent droplet to continue creating the plasma in the plasma chamber;

comparing, by the EUV controller, the measured subsequent amount of EUV energy generated to the expected amount of EUV energy to determine a subsequent stability of the plasma within the plasma chamber; and instructing, by the EUV controller and based on the determined subsequent stability of the plasma within the plasma chamber, the pulse actuator to modify by the gain factor an intensity of a further laser pulse relative to the intensity of the subsequent laser pulse.

3. The method of claim 1, wherein instructing the pulse actuator to modify the intensity of the subsequent laser pulse comprises an instruction to change an amount of radio frequency (RF) power provided to an acousto-optic modulator (AOM).

4. The method of claim 1, wherein instructing the pulse actuator to modify the intensity of the subsequent laser pulse comprises an instruction to change a high voltage applied to an electro-optic modulator (EOM) crystal.

5. The method of claim 1, wherein instructing the pulse actuator to modify the intensity of the subsequent laser pulse comprises an instruction to change a timing of triggering an electro-optic modulator (EOM) relative to a Q-switch acousto-optic modulator (AOM).

6. A laser produced plasma (LPP) extreme ultraviolet (EUV) system, comprising:

an EUV energy detector configured to measure an amount of EUV energy generated in a plasma chamber resulting from a first laser pulse having a first pulse width and a first intensity impacting a droplet to create a plasma in the plasma chamber; and an EUV controller configured to:

compare the measured amount of EUV energy generated to an expected amount of EUV energy to determine a present stability of the plasma within the plasma chamber, and instruct, based on the determined present stability of the plasma within the plasma chamber, a pulse actuator to modify by a gain factor an intensity of a subsequent laser pulse relative to the first intensity, the subsequent laser pulse also having the first pulse width.

7. The LPP EUV system of claim 6, wherein the instruction to modify the intensity of the subsequent laser pulse comprises an instruction instructing the pulse actuator to change an amount of radio frequency (RF) power provided to an acousto-optic modulator (AOM).

8. The LPP EUV system of claim 6, wherein the instruction to modify the intensity of the subsequent laser pulse comprises an instruction instructing the pulse actuator to change a high voltage applied to an electro-optic modulator (EOM) crystal.

9. The LPP EUV system of claim 6, wherein the instruction to modify the intensity of the subsequent laser pulse comprises an instruction instructing the pulse actuator to change a timing of triggering an electro-optic modulator (EOM) relative to a Q-switch acousto-optic modulator (AOM).

10. A non-transitory computer-readable medium having instructions embodied thereon, the instructions executable by one or more processors to perform operations comprising:

obtaining, from an extreme ultraviolet (EUV) energy detector, a measured amount of EUV energy generated in a plasma chamber of a laser produced plasma (LPP) EUV system resulting from a first laser pulse having a first pulse width and a first intensity impacting a droplet to create a plasma in the plasma chamber;

comparing the measured amount of EUV energy generated to an expected amount of EUV energy to determine a present stability of the plasma within the plasma chamber; and instructing, based on the determined present stability of the plasma within the plasma chamber, a pulse actuator to modify by a gain factor an intensity of a subsequent laser pulse relative to the first intensity, the subsequent laser pulse also having the first pulse width.

11. The non-transitory computer-readable medium of claim 10, wherein the operations further comprise:

obtaining, from the EUV energy detector, a measured subsequent amount of EUV energy generated from the subsequent laser pulse impacting a subsequent droplet to continue creating the plasma in the plasma chamber;

comparing the measured subsequent amount of EUV energy generated to the expected amount of EUV energy to determine a subsequent stability of the plasma within the plasma chamber; and instructing, based on the determined subsequent stability of the plasma within the plasma chamber, the pulse actuator to modify by the gain factor an intensity of a further laser pulse relative to the intensity of the subsequent laser pulse.

12. The non-transitory computer-readable medium of claim 10, wherein instructing the pulse actuator to modify the intensity of the subsequent laser pulse comprises an instruction to change an amount of radio frequency (RF) power provided to an acousto-optic modulator (AOM).

13. The non-transitory computer-readable medium of claim 10, wherein instructing the pulse actuator to modify the intensity of the subsequent laser pulse comprises an instruction to change a high voltage applied to an electro-optic modulator (EOM) crystal.

14. The non-transitory computer-readable medium of claim 10, wherein instructing the pulse actuator to modify the intensity of the subsequent laser pulse comprises an instruction to change a timing of triggering an electro-optic modulator (EOM) relative to a Q-switch acousto-optic modulator (AOM).

* * * * *